US009488153B2

(12) United States Patent
Bleil et al.

(10) Patent No.: US 9,488,153 B2
(45) Date of Patent: Nov. 8, 2016

(54) METHOD FOR OPERATING A GLOW PLUG, AND GLOW PLUG CONTROL DEVICE

(71) Applicant: BorgWarner BERU Systems GmbH, Ludwigsburg (DE)

(72) Inventors: Andreas Bleil, Ludwigsburg (DE); Yasar Güncar, Bruchsal (DE); Markus Pados, Linkenheim-Hochstetten (DE); Ralf Müller, Schwieberdingen (DE); Clemens Rinkert, Bretten (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 288 days.

(21) Appl. No.: 14/200,354

(22) Filed: Mar. 7, 2014

(65) Prior Publication Data

US 2014/0251978 A1 Sep. 11, 2014

(30) Foreign Application Priority Data

Mar. 8, 2013 (DE) ..... 10 2013 102 349

(51) Int. Cl.
*H05B 1/02* (2006.01)
*F02P 19/02* (2006.01)

(52) U.S. Cl.
CPC ..... *F02P 19/025* (2013.01); *F02P 19/022* (2013.01)

(58) Field of Classification Search
CPC ... F05P 19/025; F02P 19/022; H05B 1/0236; H05B 3/0042; H05B 3/026; H05B 2203/027
USPC ..... 219/494, 202, 203, 206, 497, 505, 492, 219/209, 210; 123/145 A, 145 R
See application file for complete search history.

(56) References Cited

U.S. PATENT DOCUMENTS

| | | | | |
|---|---|---|---|---|
| 7,973,567 | B2 | 7/2011 | Vorenkamp | |
| 8,166,946 | B2 * | 5/2012 | Sekiguchi | F02P 19/02 123/179.3 |
| 8,890,554 | B2 * | 11/2014 | Tanihara | H02M 3/156 324/750.01 |
| 2009/0183718 | A1 * | 7/2009 | Casasso | F02P 19/025 123/623 |
| 2010/0102845 | A1 * | 4/2010 | Kadow | H03K 17/0822 324/762.09 |
| 2011/0000901 | A1 * | 1/2011 | Bauer | F02P 19/025 219/494 |
| 2011/0303650 | A1 * | 12/2011 | Sakurai | F02P 19/025 219/263 |

(Continued)

FOREIGN PATENT DOCUMENTS

| | | |
|---|---|---|
| DE | 10 2004 041 886 A1 | 3/2006 |
| DE | 10 2007 056 581 A1 | 6/2009 |

(Continued)

*Primary Examiner* — Mark Paschall
(74) *Attorney, Agent, or Firm* — Bose McKinney & Evans LLP

(57) ABSTRACT

A method for operating a glow plug by means of pulse-width-modulated voltage pulses which are generated by controlling a load transistor, wherein a heating current flowing through the glow plug is measured and the duty cycle of the pulse-width-modulated voltage pulses is changed in accordance with values of the heating current. The heating current can be measured by means of a current measurement circuit, through which a sense current flows parallel to the load transistor, and the value of the heating current is calculated by multiplying a measured value of the sense current by a kILIS factor, wherein the temperature of the current measurement circuit is measured and the kILIS factor is defined in accordance with the measured circuit temperature. A glow plug control device is also disclosed.

12 Claims, 1 Drawing Sheet

(56) References Cited

U.S. PATENT DOCUMENTS

2013/0160730 A1* 6/2013 Kan ..... F23Q 7/001
123/145 A

FOREIGN PATENT DOCUMENTS

DE 10 2009 046 181 A1 5/2010
EP 2 254 215 A1 11/2010

* cited by examiner

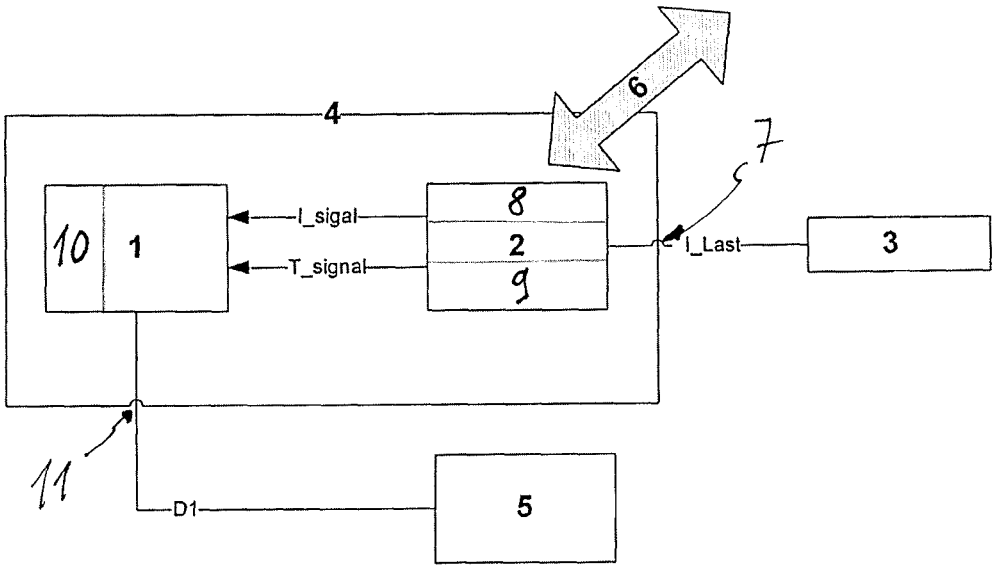
4
6
7
10
1
I_sigal
T_signal
8
2
9
I_Last
3
11
D1
5

METHOD FOR OPERATING A GLOW PLUG, AND GLOW PLUG CONTROL DEVICE

RELATED APPLICATIONS

This application claims priority to DE 10 2013 102 349.5, filed Mar. 8, 2013, the entire disclosure of which is hereby incorporated herein by reference in its entirety.

BACKGROUND

The invention relates to a method for operating a glow plug by means of pulse-width-modulated voltage pulses and also to a glow plug control device.

Modern glow plug control devices have a load transistor for each glow plug connection terminal, said transistor being switched by a control unit between its conductive state and its blocking state. Pulse-width-modulated voltage pulses are thus generated and applied to a glow plug. The duty cycle of the pulse-width-modulated voltage pulses is adapted by the glow plug control device in relation to the strength of the heating current flowing through the load transistor and the glow plug, either so as to regulate the glow plug temperature or in order to feed a predefined electric power into the glow plug so as to control the glow plug temperature.

To measure the current flowing through a load transistor, current measurement circuits are known which have a sense transistor or other semiconductor element connected in parallel to the load transistor. With current measurement circuits of this type, which are described for example in DE 10 2009 046 181 A1, the current flowing through the load transistor is proportional to the measurement current flowing through the sense transistor. This proportionality factor is referred to as the kILIS factor or k-factor, such that the value of the current flowing through the load transistor can be calculated by multiplying the measurement current by the kILIS factor.

Load transistors comprising such current measurement circuits are commercially obtainable as integrated semiconductor elements. For example, STMicroelectronics provides such a semiconductor element identified by the following number: VND5004A-E. The kILIS factor is specified on the manufacturer's datasheet.

SUMMARY

The present invention teaches how the temperature of a glow plug can be brought with greater accuracy to a desired value and/or kept at a desired value.

In accordance with this disclosure, a precise current measurement is achieved by defining the kILIS factor of the used current measurement circuit as a function of the temperature thereof, which is measured for this purpose. The temperature of a glow plug control device and therefore also the temperature of the current measurement circuit may fluctuate so severely during operation of a motor vehicle that this leads to a noticeable change to the kILIS factor. Since the temperature dependence of the kILIS factor is taken into consideration, a much more precise current measurement and consequently also a more precise control of the glow plug temperature is therefore possible.

In order to define the value of the kILIS factor in accordance with the circuit temperature, a characteristic curve can be used for example, which specifies the value of the kILIS factor in accordance with the circuit temperature. In the simplest case, two reference values are sufficient, which have been established for different temperatures and each specify the value of the kILIS factor at one of these temperatures.

A characteristic curve, reference values or other calibration data with which a value of the kILIS factor can be determined for a measured circuit temperature can be stored in a memory of a glow plug control device. A control unit of the glow plug control device, for example an ASIC or a microprocessor, can calculate a value of the kILIS factor for each measured circuit temperature using this calibration data.

The calibration data for defining the kILIS factor in a temperature-dependent manner can be established by measurements taken on the control circuits before installation in a glow plug control device. The calibration data is preferably established however by measurements taken on a glow plug control device. This can be achieved for example by connecting a defined measuring resistor instead of a glow plug to the glow plug control device. If the supply voltage provided to the glow plug control device is known, the current flowing through the load transistor can then be calculated as a quotient of supply voltage and value of the measuring resistor. Since the glow plug control device simultaneously measures the sense current flowing through the current measurement circuit, all information for determining the kILIS factor is provided at the circuit temperature then provided. It is then sufficient to provide the value of the measuring resistor to the control unit of the glow plug control device, which can then calculate a reference value as calibration data and this can be stored in the memory.

In an advantageous refinement of this disclosure, the glow plug control device has a data connection. Calibration data for defining the kILIS factor in a temperature-dependent manner or data from which the control unit of the glow plug control device then calculates such calibration data can be fed via this data connection into the glow plug control device. For example, the value of the measuring resistor can be fed via the data connection, said resistor being connected instead of a glow plug to the glow plug control device, or the value of the load current at the moment of calibration can be transmitted via the data connection.

In a further advantageous refinement of this disclosure, a current dependence of the kILIS factor is also taken into account in addition to the temperature dependence. In a method according to this disclosure a further improvement can be attained by defining the kILIS factor as a function of the intensity of the measurement current. With a glow plug control device according to this disclosure the control circuit is therefore preferably designed to assign to the kILIS factor a value that is determined in relation to a measured value of the sense current with use of calibration data that concerns the current dependence of the kILIS factor and is stored in the data memory. The calibration data can be established for this purpose similarly to the calibration data for temperature-dependent determination of the kILIS factor and can be stored in the memory of the glow plug control device. Calibration data for the temperature- and current-dependent determination of the kILIS factor can be present, for example, as a characteristic field or array that assigns a value of the kILIS factor to a combination of a temperature value and a current value.

In a further advantageous refinement of this disclosure, individual calibration data for each load transistor is stored in the memory of the glow plug control device. Fluctuations, caused by the manufacturing process, in the kILIS factors of different current measurement circuits can thus also be compensated for advantageously.

In a further advantageous refinement of this disclosure, the current measurement circuit may be an integrated semiconductor element, for example a VND5004A-E by STMicroelectronics.

The temperature sensor for measuring the temperature of the measurement circuit can be arranged within a housing of the glow plug control device, for example on a circuit carrier plate which carries the current measurement circuits. For example, a measuring resistor, for example a PT100, can be used as a temperature sensor. Measuring resistors for temperature measurement are also referred to as resistance thermometers. The temperature sensor can also be integrated in a semiconductor element which contains the load transistor and the current measurement circuit.

A method according to this disclosure may be implemented as a method for regulating the temperature of a glow plug, in which the electrical resistance or another temperature-dependent control variable of the glow plug is established from a current measurement and a voltage measurement and is regulated by closed-loop control to a target value, which is to be assigned to a target temperature of the glow plug.

BRIEF DESCRIPTION OF THE DRAWINGS

Further details and advantages of this disclosure will be explained on the basis of an illustrative embodiment with reference to the accompanying drawing, in which:

FIG. 1 shows a schematic illustration of a glow plug control device.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

The glow plug control device 4 illustrated schematically in FIG. 1 contains a control unit 1, for example an ASIC or a microcontroller, which controls a load transistor 2, for example a MOSFET or another field-effect transistor, in order to thus generate a pulse-width-modulated voltage which is provided for a glow plug at a glow plug connection terminal 7 of the glow plug control device. The load transistor 2 may be part of an integrated semiconductor element which additionally contains a current measurement circuit, to which the load transistor 2 is connected in parallel. The current measurement circuit contains a sense transistor 8, through which a sense current flows parallel to the load transistor 2. The glow plug control device has a plurality of glow plug connection terminals 7, to each of which a load transistor is connected in series. For the sake of simplicity, only a single glow plug connection terminal 7 is illustrated in FIG. 1.

The control unit 1 changes the duty cycle of the pulse-width-modulated voltage pulses in relation to the intensity of the heating current flowing through a glow plug connected to the glow plug connection terminal 7. The change to the duty cycle can be implemented within the scope of an open-loop control of the glow plug so that an accurately predefined power is fed into the glow plug, or within the scope of a temperature regulation by closed-loop control, in which the glow plug temperature is regulated to a temperature target value or a target value of the electrical resistance of the glow plug. The glow plug control device for this purpose contains a voltage measurement device, which can be integrated into the control unit 1.

The control unit 1 calculates from measured values of the sense current a value for the current flowing through the load transistor 2 by multiplying the measured value of the sense current by a kILIS factor. The kILIS factor is measured by the control unit 1 as a function of strength the of the sense current and of the temperature of the current measurement circuit. A circuit carrier plate which carries the current measurement circuit comprising the load transistor 2 and the sense transistor 8 also carries a temperature sensor 9, for example a temperature measuring resistor.

To calculate the kILIS factor as a function of the measured temperature, the control unit 1 requires calibration data, which is stored in a memory 10 of the glow plug control device. The memory 10 is a semi-permanent memory, that is to say a memory in which stored information remains when the power supply is switched off, but which can be altered by writing processes, for example an EEPROM.

The calibration data is generated by connecting a defined measuring resistor 3 instead of a glow plug to the glow plug connection terminal 7 of the glow plug control device and then applying a defined supply voltage to the measuring resistor 3 via the load transistor 2. The control unit 1 then receives a temperature signal from the temperature sensor 9 and also a current signal from the current sense circuit, that is to say a current signal of the sense current flowing through the sense transistor 8. The control unit 1 then calculates, from the temperature value thus obtained and the value of the measurement current together with a measured value of the supply voltage and the value of the electrical resistance of the measuring resistor 3, a reference value for the kILIS factor. This procedure is repeated at different temperatures and current intensities. Reference values of the kILIS factor are thus generated for different temperatures and current intensities.

During subsequent operation, when a glow plug is connected instead of the measuring resistor 3 to the glow plug connection terminal 7, the control unit 1 can then define a value of the kILIS factor at a measured temperature value and a measured current value by interpolation and/or extrapolation of the reference values.

The glow plug control device 4 is exposed to a temperature source 6 in order to establish reference values at different circuit temperatures, for example is heated or cooled in a measuring cell. The value of the respective measuring resistor 3*a* used or of the load current resulting therefrom is provided to the control unit via a data input 11 of the glow plug control device, for example by means of an input device 5.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for operating a glow plug in which the duty cycle of pulse-width-modulated voltage pulses generated by controlling a load transistor is changed as a function of the heating current flowing through the glow plug, the method comprising:

providing a current measurement circuit through which a sense current flows parallel to the load transistor;

measuring the sense current;

measuring the temperature of the current measurement circuit;

defining a kILIS factor as a function of the measured circuit temperature; and calculating the value of the heating current by multiplying the measured value of the sense current by the defined kILIS factor.

2. The method according to claim 1, wherein a temperature dependence of the kILIS factor is taken into account with a characteristic curve or at least two different reference values that have been established for different temperatures.

3. The method according to claim 1, wherein the kILIS factor is defined in relation to the intensity of the sense current.

4. The method according to claim 1, wherein the current measurement circuit comprises a sense transistor which is connected in parallel to the load transistor and through which the sense current flows.

5. The method according to claim 1, further comprising measuring electric voltage, calculating a temperature-dependent control variable of the glow plug from the measured voltage value and a measured value of the heating current, and regulating the control variable to a target value associated with a target temperature of the glow plug.

6. The method of claim 5, wherein the temperature-dependent control variable is resistance of the glow plug.

7. A glow plug control device, comprising:

a plurality of glow plug connection terminals, wherein each glow plug connection terminal is connected in series to a load transistor;

a current measurement circuit connected in parallel to each load transistor;

a data memory which stores calibration data of the temperature dependence of a kILIS factor; and a control circuit for controlling the load transistors, the control circuit having a temperature sensor for measuring the measurement circuit temperature, the control circuit being configured to:

(a) determine the kILIS factor as a function of a measured value of the circuit temperature, (b) measure a sense current flowing through the current measurement circuit, and (c) multiply the measured sense current by the determined kILIS factor to calculate the value of the heating current flowing through the glow plug.

8. The glow plug control device according to claim 7, further comprising a data connection for reading calibration data or data for calculating calibration data of the kILIS factor.

9. The glow plug control device according to claim 7, wherein the control circuit is configured to determine the kILIS factor using the stored calibration data.

10. The glow plug control device according to claim 7, wherein individual calibration data for each load transistor is stored in the data memory.

11. The glow plug control device according to claim 7, wherein the current measurement circuit is an integrated semiconductor element.

12. The glow plug control device according to claim 7, wherein the temperature sensor sits on a circuit carrier plate which carries the current measurement circuit.

* * * * *